US007837198B2

(12) United States Patent
Nishitsuji et al.

(10) Patent No.: US 7,837,198 B2
(45) Date of Patent: Nov. 23, 2010

(54) SYMBOL DISPLAY DEVICE FOR GAME MACHINE

(75) Inventors: Takashi Nishitsuji, Sagamihara (JP); Masao Mizoguchi, Atsugi (JP)

(73) Assignee: Konami Gaming, Inc., Las Vegas, NV (US)

( * ) Notice: Subject to any disclaimer, the term of this patent is extended or adjusted under 35 U.S.C. 154(b) by 35 days.

(21) Appl. No.: 12/260,308

(22) Filed: Oct. 29, 2008

(65) Prior Publication Data

US 2010/0102508 A1 Apr. 29, 2010

(51) Int. Cl.
*A63F 1/18* (2006.01)

(52) U.S. Cl. ..... 273/143 R

(58) Field of Classification Search ..... None
See application file for complete search history.

(56) References Cited

U.S. PATENT DOCUMENTS 5,752,881 A * 5/1998 Inoue ..... 463/20
6,012,982 A * 1/2000 Piechowiak et al. ..... 463/16
6,168,523 B1 * 1/2001 Piechowiak et al. ..... 463/26
6,190,254 B1 * 2/2001 Bennett ..... 463/13
6,715,756 B2 * 4/2004 Inoue ..... 273/143 R
6,805,349 B2 * 10/2004 Baerlocher et al. ..... 273/138.2
6,893,018 B2 * 5/2005 Inoue ..... 273/143 R
6,923,441 B2 * 8/2005 Inoue ..... 273/143 R
7,207,883 B2 * 4/2007 Nozaki et al. ..... 463/24
7,241,220 B2 * 7/2007 Rothkranz et al. ..... 463/20
2004/0000754 A1 * 1/2004 Inoue ..... 273/143 R
2007/0054727 A1 * 3/2007 Garamendi et al. ..... 463/16
2008/0096652 A1 * 4/2008 Shimizu ..... 463/31

* cited by examiner

*Primary Examiner*—Alvin A Hunter
*Assistant Examiner*—Dolores Collins
(74) *Attorney, Agent, or Firm*—Sughrue Mion, PLLC

(57) ABSTRACT

A symbol display device for a game machine includes a reel unit having a plurality of reels, each having a peripheral surface with a plurality of peripheral symbols. A reel supporting member that supports the reels rotatably and independently includes a lateral wall having a plurality of lateral symbols arranged around the rotational axis of the end reel, whereby any one of the lateral symbols is indicated by a pointer that rotates about the rotational axis of the end reel. A pivoting unit pivots the reel unit to a first angular position where the peripheral surfaces of the reels are observable and to a second angular position where the pointer and the lateral symbols on the lateral wall of the reel supporting member are observable. The pivoting unit is located above the reel unit.

15 Claims, 10 Drawing Sheets

Fig. 15

| ANGLE OF THE REEL UNIT (DEGREES) | NUMBER OF PHOTOSENSOR | | |
|---|---|---|---|
| | 110 | 112 | 114 |
| −90 < ANGLE < −180 | ON | OFF | OFF |
| ANGLE = −90 (LEFT SIDE IS SEEN) | OFF | OFF | OFF |
| 0 < ANGLE < −90 | ON | ON | OFF |
| ANGLE = 0 (FRONT FACE IS SEEN) | OFF | ON | OFF |
| 0 < ANGLE < 90 | ON | ON | ON |
| ANGLE = 90 (RIGHT SIDE IS SEEN) | OFF | OFF | ON |
| 90 < ANGLE < 180 | ON | OFF | ON |

* "ON" MEANS THAT THE BEAM IS INTERRUPTED BY THE CORRESPONDING DISK.

SYMBOL DISPLAY DEVICE FOR GAME MACHINE

BACKGROUND OF THE INVENTION

1. Field of the Invention

The present invention relates to a symbol display device for use in game machines.

2. Related Art

A game machine, such as a slot machine, includes a reel unit having a plurality of reels supported rotatably and independently, each having a peripheral surface with a plurality of peripheral symbols. When the reels stop rotating, it is determined whether or not the combination of the symbols on the reels corresponds to any one of predetermined prize patterns.

U.S. Pat. No. 6,715,756 discloses a slot machine including a special symbol display device in addition to the usual reels. This special symbol display device is arranged above the usual reels and has a single reel with a first display portion on its side surface and with a second display portion on its periphery. When a player wins a normal slot game using the usual reels, this special symbol display device enables players to play subsidiary games. In performing a first subsidiary game, the side surface of the special single reel is perpendicular so that the first display portion is observable. In performing a second subsidiary game, the periphery of the special single reel is horizontal so that the second display portion is observable.

However, such a special symbol display device arranged at a different position from the usual reels results in a waste of space.

SUMMARY OF THE INVENTION

The present invention provides a symbol display device having a plurality of reels for use in a game machine that can enable players to play a plurality of types of games, including games using the plurality of reels, and that may allow effective use of space.

In accordance with the present invention, a symbol display device for a game machine includes a reel unit including: a plurality of reels each having a rotational axis and aligned in a manner such that the rotational axes are coincident or substantially parallel, each of the reels having a peripheral surface at which a plurality of peripheral symbols are displayed, the reels including an end reel arranged at an end position of the reels; a reel supporting member that supports the reels rotatably and independently, the reel supporting member including a lateral wall having a plurality of lateral symbols arranged around the rotational axis of the end reel; a plurality of driving units that rotate the reels respectively; and a pointer that rotates about the rotational axis of the end reel due to rotation of the end reel, the pointer indicating one of the lateral symbols on the lateral wall of the reel supporting member when the end reel and the pointer stop rotating. The symbol display device further includes a pivoting unit that pivots the reel unit to a first angular position at which the peripheral surfaces of the reels are observable and to a second position at which the pointer and the lateral symbols on the lateral wall of the reel supporting member are observable, the pivoting unit being located above the reel unit.

By virtue of the single reel unit according to the present invention, players can play a plurality of types of games, including a game using the plurality of reels, and the space is effectively used. When the pivoting unit pivots the reel unit to the first angular position, players can play a first game using the peripheral surfaces of the plurality of reels. When the pivoting unit pivots the reel unit to the second position, players can play a second game using the end reel with which the rotatable pointer is engaged. Since the pivoting unit is located above the reel unit, the pivoting unit need not bear the entire weight of the reel unit, and the reel unit can be disengaged from and engaged with the pivoting unit easily. Accordingly, the reel unit can be repaired easily.

Preferably, the reels include a second end reel arranged at a second end position of the reels opposite to the end reel, the reel supporting member including a second lateral wall having a plurality of second lateral symbols arranged around the rotational axis of the second end reel, the reel unit including a second pointer that rotates about the rotational axis of the second end reel due to rotation of the second end reel, the second pointer indicating one of the second lateral symbols on the second lateral wall of the reel supporting member when the second end reel and the second pointer stop rotating, the pivoting unit further pivoting the reel unit to a third angular position at which the second pointer and the second lateral symbols on the second lateral wall of the reel supporting member are observable. When the pivoting unit pivots the reel unit to the third angular position, players can play a third game using the second end reel with which the second rotatable pointer is engaged.

Preferably, at least one of the lateral symbols and the second lateral symbols are changeably displayed by one or more electronic display devices.

The reel supporting member of the reel unit may further include a bottom wall having a lower surface, and the reel unit may further include a plurality of casters, each including a bracket mounted on the lower surface of the reel supporting member and a roller rotatably attached to the bracket for facilitating pivoting of the reel unit. Since the casters facilitate pivoting of the reel unit, the energy consumption of the pivoting unit can be reduced.

The symbol display device may further include a base including an upper surface which faces the lower surface of the bottom wall of the reel supporting member, a projection located at one of the upper surface of the base and the lower surface of the bottom wall, and a surrounding wall located at the other of the upper surface of the base and the lower surface of the bottom wall, the projection being aligned with a pivot axis of the reel unit, the surrounding wall surrounding the projection. Since the surrounding wall surrounds the projection aligned with the pivot axis of the reel unit, the reel unit can be pivoted stably without deviating from the concentricity to the pivot axis. In addition, the surrounding wall and the projection can be used as means for guiding the reel unit when the reel unit is engaged with the pivoting unit. More specifically, if the projection is received in the surrounding wall, the reel unit is positioned appropriately.

The reel supporting member of the reel unit may further include a top wall having a top surface, and the symbol display device may further include: a pivot shaft pivoted by the pivoting unit, the pivot shaft extending upwardly from the top surface of the top wall; a pair of disks located around the pivot shaft at different elevations; and three photosensors each having a light-emitting element that emits light and a light-receiving element that receives the light from the light-emitting element when there is no interruption between the light-emitting element and the light-receiving element, a part of one of the disks being capable of being interposed between the light-emitting element and the light-receiving element of the photosensor due to pivoting of the pivot shaft. The disks have different contours and the photosensors arranged so that a combination of light reception states of the light-receiving elements of the photosensors is variable when the reel unit is positioned at the first angular position, the second position, and the third angular position. In this case, using the combination of the light reception states of the photosensors, the pivot angular position of the reel unit can be determined appropriately from among the first angular position, the second position, and the third angular position.

The disks may have different contours and the photosensors are arranged so that a combination of light reception states of the light-receiving elements of the photosensors is variable when the reel unit is positioned at the first angular position, the second position, the third angular position, a position between the first and the second positions, a position between the second and the third angular positions, and a position between the third and the first angular positions. In this case, using a combination of the light reception states of the photosensors, the pivot angular position of the reel unit can be determined appropriately from among the first angular position, the second position, the third angular position, a position between the first and the second positions, a position between the second and the third angular positions, and a position between the third and the first angular positions.

In the symbol display device, the rotational shaft for the end reel may penetrate through the lateral wall of the reel supporting member, and the pointer may be mounted on the rotational shaft. Also, the second rotational shaft for the second end reel may penetrate through the second lateral wall of the reel supporting member, and the second pointer may be mounted on the second rotational shaft. When each of the rotational shaft and the second rotational shaft is of a small cross section, the area of each of the lateral wall and the second lateral wall can be large, so that the symbols on the walls can be large enough to be seen easily.

In accordance with another aspect of the present invention, a game machine includes the above-described symbol display device.

BRIEF DESCRIPTION OF THE DRAWINGS

The present invention will be described with reference to various embodiments of the invention, with reference to the accompanying drawings, which illustrate a plurality of forms of the invention, described as examples only. The various forms of the present invention are described as examples only in the accompanying diagrammatic drawings in which:

FIG. 15 is a table showing the relationship between the angle of the reel unit and the reception states of light-receiving elements of photosensors used in the embodiment.

DETAILED DESCRIPTION OF PREFERRED EMBODIMENTS OF THE INVENTION

Figure 1:
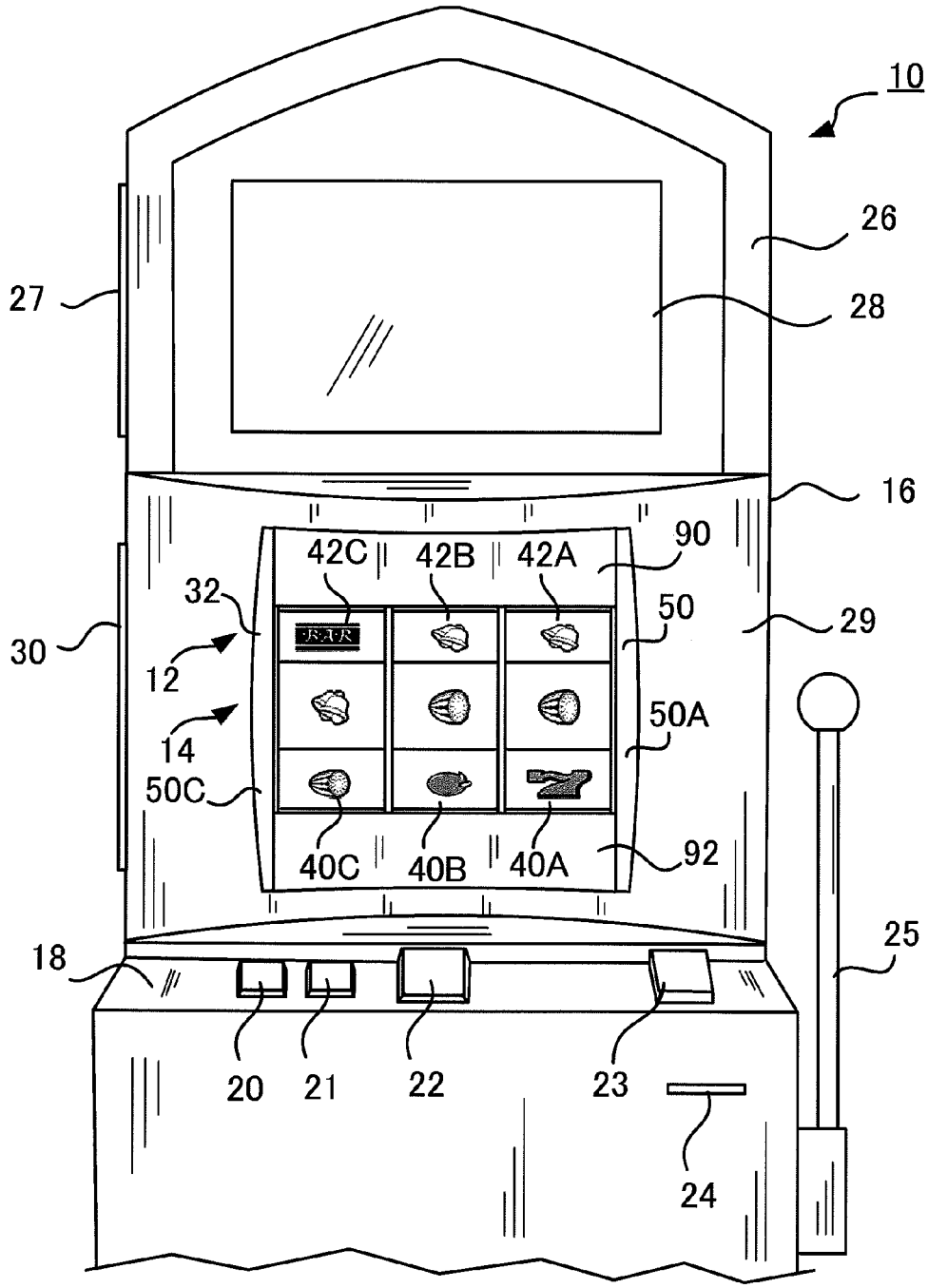
FIG. 1 is a front view of a game machine including a symbol display device according to an embodiment of the present invention having a reel unit that has stopped at a first angular position.

As shown in FIG. 1, a game machine 10 according to a first embodiment of the present invention includes a symbol display device 12 that has a reel unit 14. In the state shown in FIG. 1, the reel unit 14 has been stopped at a first angular position that will be described in more detail later.

The game machine 10 in the embodiment is a slot machine, but it may be another type of game machine. The game machine 10 comprises a housing 16 including a front stage 18 on which are mounted various buttons, e.g., a cash button 20, a bet button 21, a spin button 22, and a credit button 23. This game machine 10 is an automatic-stop type, in which each reel is automatically stopped, so that no stop buttons are provided. However, this game machine 10 may be of a manual-stop type having stop buttons (not shown) that are pushed by players for stopping the reels of the reel unit 14, respectively.

The lower front panel of the housing 16 that is below the front stage 18 has a coin slot 24 into which coins are inserted. A spin lever 25 is rotatably mounted on the right side panel of the housing 16.

An upper front door 26 is openably and closeably connected via a hinge 27 to the housing 16. An electronic display device 28 is mounted on the upper front door 26 for displaying various information and guidance with regard to the game machine 10. The electronic display device 28 may be a liquid crystal display, a plasma display, an organic electroluminescent display, a light emitting diode display, an electrophoretic display, or any other suitable electronic display device.

The symbol display device 12 is located inside the housing 16. A lower front door 29 is openably and closeably connected via a hinge 30 to the housing 16 for protecting the symbol display device 12. A window 32 covered with a transparent panel is formed at the lower front door 29, so that a part of the symbol display device 12 can be seen through the window 32.

Figure 2:
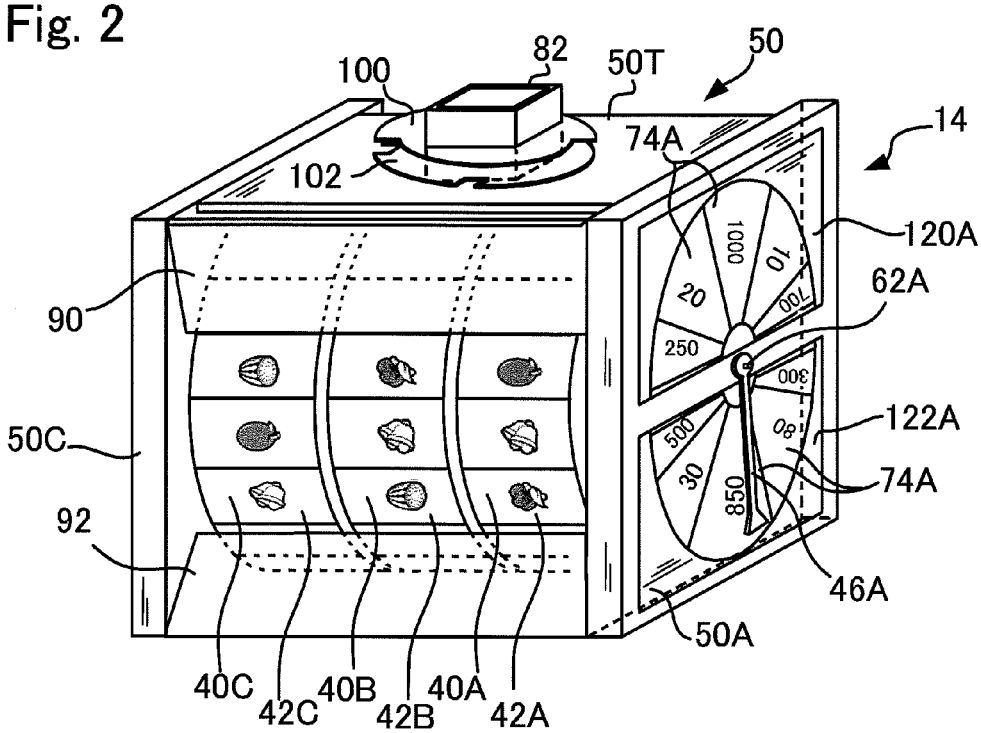
FIG. 2 is a perspective view of the symbol display device.
Figure 3:
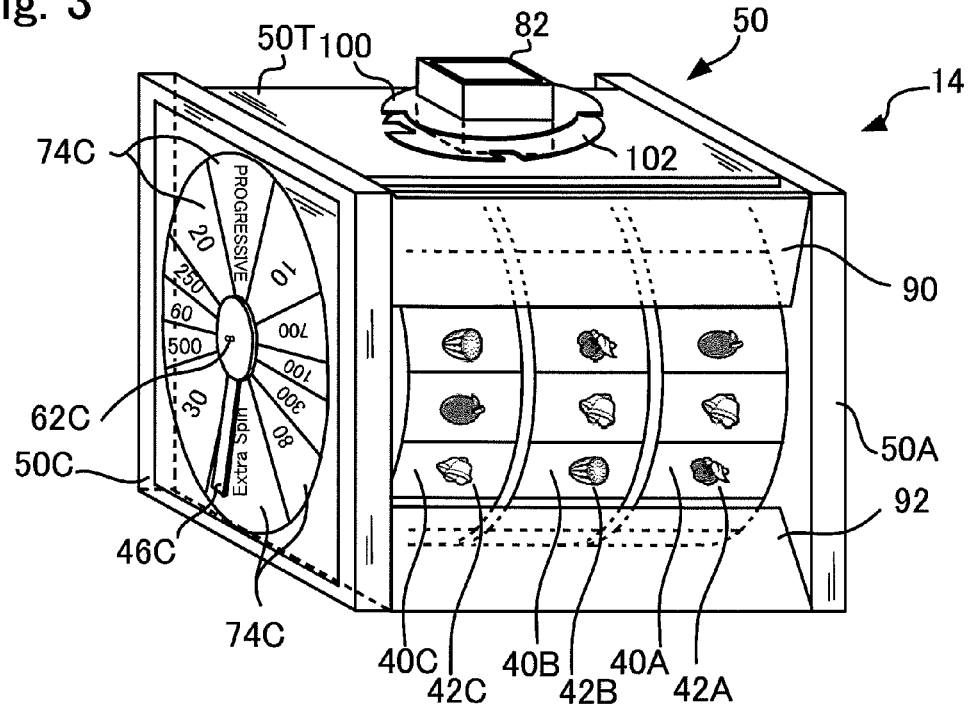
FIG. 3 is another perspective view of the symbol display device.
Figure 4:
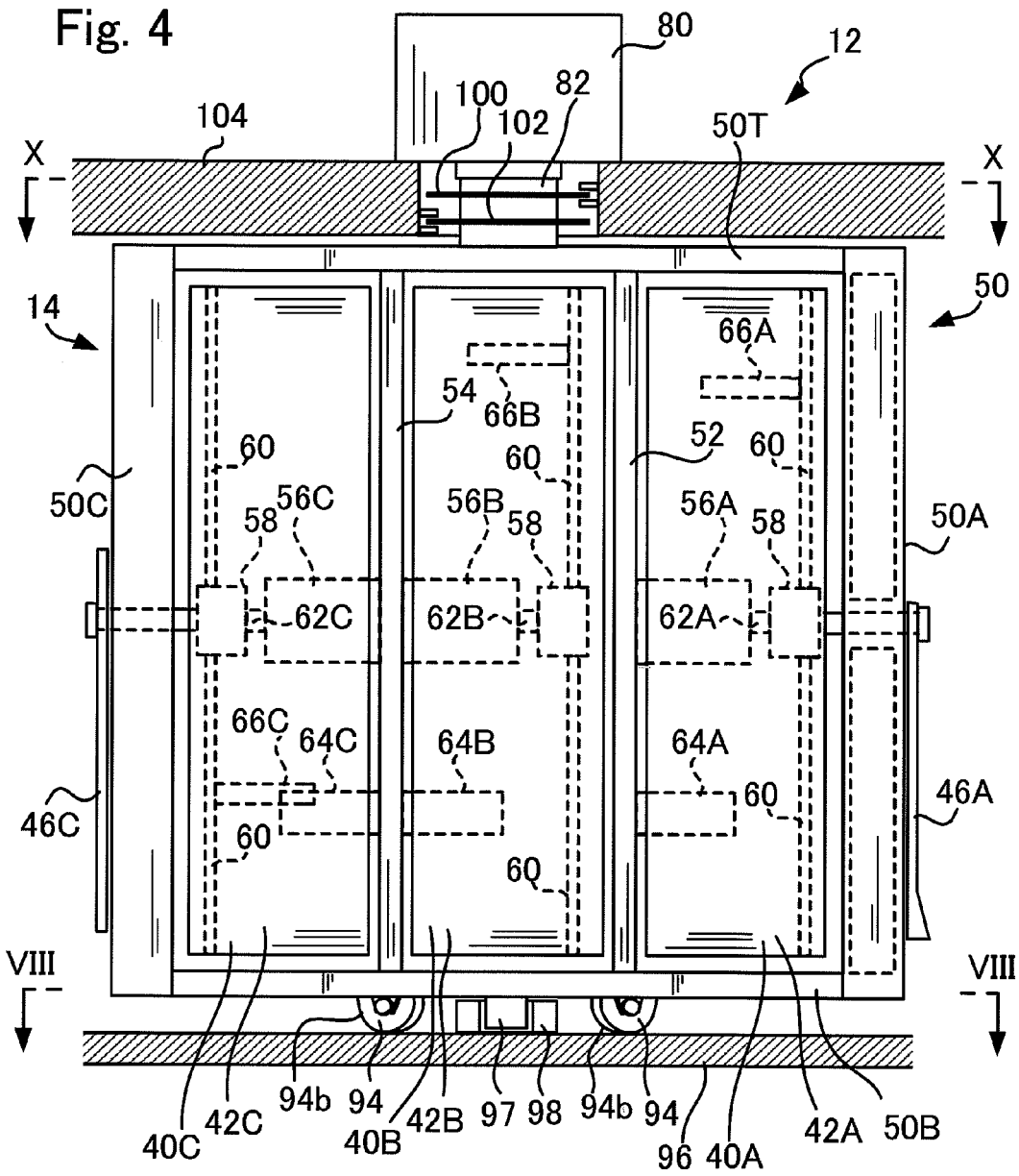
FIG. 4 is a front view of the symbol display device.

Details of the symbol display device 12 are shown in FIGS. 2 through 4. The symbol display device 12 includes a reel unit 14. The reel unit 14 includes a plurality of (three) rotatable reels, namely, a right-end reel 40A, a center reel 40B, and a left-end reel 40C, each having a rotational axis and aligned in manner such that the rotational axes are coincident with one another. In an alternative embodiment (not shown), the rotational axes of the reels 40A, 40B, and 40C may be substantially parallel to one another. Preferably, the cylindrical reels 40A, 40B, and 40C are of the same size, but the present invention is not limited to the illustrated embodiment.

As shown in FIGS. 2 and 3, each of the reels 40A, 40B, and 40C has a peripheral surface 42A, 42B, or 42C at which a plurality of peripheral symbols are displayed in a manner similar to that of reels in conventional slot machines. When the reels stop rotating, it is determined whether or not the combination of the symbols on the reels corresponds to any one of predetermined prize patterns.

As shown in FIGS. 2 through 4, the reel unit 14 also includes a reel supporting member or reel case 50 that supports the reels 40A, 40B, and 40C rotatably and independently. Generally, the reel case 50 is of a hollow cubic shape having a right lateral wall 50A, a left lateral wall 50C, a top wall 50T connected to the lateral walls 50A and 50C, and a bottom wall 50B (see FIG. 4) connected to the lateral walls 50A and 50C. The reels 40A, 40B, and 40C are located in the space between the lateral walls 50A and 50C.

As is best shown in FIG. 4, two inner walls or supporting plates 52 and 54 that are arranged in parallel are located within the reel case 50. The supporting plates 52 and 54 are fixed to the top and bottom walls 50T and 50B of the reel case 50.

The reel unit 14 further includes a plurality of driving units, namely, reel motors 56A, 56B, and 56C that rotate the reels 40A, 40B, and 40C, respectively. The right-end reel motor 56A is mounted on the right supporting plate 52, whereas the center reel motor 56B and the left-end reel motor 56C are mounted on the left supporting plate 54.

Generally, each of the reels 40A, 40B, and 40C is of a hollow cylindrical shape. In addition, each of the reels 40A, 40B, and 40C has a center hub 58 located at the center of the hollow cylindrical shape and a plurality of spokes 60 radially extending outward from the hub 58. The outermost ends of the spokes 60 are fixed to the inner surface of the hollow cylindrical reels 40A, 40B, and 40C.

The right-end reel motor 56A has a rotational shaft 62A to which the hub 58 of the right-end reel 40A is fixed. The center reel motor 56B has a rotational shaft 62B to which the hub 58 of the center reel 40B is fixed. The left-end reel motor 56C has a rotational shaft 62C to which the hub 58 of the left-end reel 40C is fixed. Thus, the reel motors 56A, 56B, and 56C directly rotate the corresponding reels 40A, 40B, and 40C, independently.

Each of the reel motors 56A, 56B, and 56C is of a type in which the rotational angle can be controlled and stopped precisely. For example, a stepping motor may be preferably used for the reel motors. Although the reel motors 56A, 56B, and 56C directly rotate the corresponding reels 40A, 40B, and 40C in the illustrated embodiment, a suitable transmission mechanism, e.g., a gear transmission mechanism, a belt-pulley transmission mechanism, or a chain-sprocket mechanism, may be used for transmitting the individual movement of the driving unit to the corresponding reel in an alternative embodiment (not shown).

The reel unit 14 further includes a plurality of sensors, namely, reel sensors 64A, 64B, and 64C for estimating the rotational angle of the reels 40A, 40B, and 40C, respectively. Each of the reel sensors 64A, 64B, and 64C is, e.g., a photosensor or a proximity sensor. The right-end reel sensor 64A mounted on the right supporting plate 52 detects a segment 66A mounted on one of the spokes 60 of the right-end reel 40A when the segment 66A passes the right-end reel sensor 64A due to rotation of the right-end reel 40A. The center reel sensor 64B mounted on the left supporting plate 54 detects a segment 66B mounted on one of the spokes 60 of the center reel 40B when the segment 66B passes the center reel sensor 64B due to rotation of the center reel 40B. The left-end reel sensor 64C mounted on the left supporting plate 54 detects a segment 66C mounted on one of the spokes 60 of the left-end reel 40C when the segment 66C passes the left-end reel sensor 64C due to rotation of the left-end reel 40C. The number of pulses input to the reel motor after the time of the last detection of the segment by the corresponding sensor is related to the rotational angle of the corresponding reel. Therefore, the control system (center processing unit) of the slot machine can estimate the rotational angle of each reel on the basis of the detection signal from the reel sensor.

The rotational shaft 62A for the right-end reel 40A penetrates through the right lateral wall 50A of the reel case 50. A first rotatable pointer 46A is mounted on the distal end of the rotational shaft 62A, so that the first rotatable pointer 46A rotates about the rotational axis of the right-end reel 40A due to rotation of the right-end reel 40A. The first rotatable pointer 46A is of an elongated shape radially extending outward from the rotational shaft 62A.

The rotational shaft 62C for the left-end reel 40C penetrates through the left lateral wall 50C of the reel case 50. A second rotatable pointer 46C is mounted on the distal end of the rotational shaft 62C, so that the second rotatable pointer 46C rotates about the rotational axis of the left-end reel 40C due to rotation of the left-end reel 40C. The second rotatable pointer 46C is of a generally elongated shape radially extending outward from the rotational shaft 62C.

The shape of the pointers 46A and 46C is not intended to be limited to the illustrated embodiment, and other shapes can be used.

As shown in FIG. 2, the right lateral wall (first lateral wall) 50A of the reel case 50 has a plurality of first lateral symbols 74A, each of which has a generally sectorial shape. The first lateral symbols 74A are arranged around the rotational shaft 62A for the right-end reel 40A, whereby the first rotatable pointer 46A indicates one of the lateral symbols 74A on the right lateral wall 50A of the reel case 50 when the right-end reel 40A and the first rotatable pointer 46A stop rotating.

As shown in FIG. 3, the left lateral wall (second lateral wall) 50C of the reel case 50 has a plurality of second lateral symbols 74C, each of which has a generally sectorial shape. The second lateral symbols 74C are arranged around the rotational shaft 62C for the left-end reel 40C, whereby the second rotatable pointer 46C indicates one of the lateral symbols 74C on the left lateral wall 50C of the reel case 50 when the left-end reel 40C and the second rotatable pointer 46C stop rotating.

As shown in FIG. 4, the symbol display device 12 further includes a pivoting unit or reel unit motor 80 that pivots the reel unit 14 in a horizontal plane. The reel unit motor 80 is engaged with a pivot shaft 82 extending upwardly from the top surface of the top wall 50T of the reel case 50. Thus, the reel unit motor 80 directly rotates the reel unit 14 as a whole. Since each of the rotational shaft 62A and the rotational shaft 62C has a small cross section, the area of each of the right lateral wall 50A and the left lateral wall 50C can be large, so that the symbols 74A and 74C on the walls 50A and 50C can be so large as to be readily visible.

The reel unit motor 80 is of a type in which the pivot angle can be controlled and stopped precisely. For example, a stepping motor may be preferably used for the reel unit motor. Although the reel unit motor 80 directly pivots the reel case 50 in the illustrated embodiment, a suitable transmission mechanism, e.g., a gear transmission mechanism, a belt-pulley transmission mechanism, or a chain-sprocket mechanism may be used for transmitting the movement of the pivoting unit to the reel unit in an alternative embodiment (not shown).

The reel unit motor 80 pivots the reel unit 14 to a first angular position at which the peripheral surfaces 42A, 42B, and 42C of the reels 40A, 40B, and 40C are observable through the window 32 of the lower front door 29 as shown in FIG. 1. After the reel unit motor 80 pivots the reel unit 14 to the first angular position and stops the reel unit 14 at the first angular position, players can play a first game, i.e., a normal slot game using the peripheral surfaces 42A, 42B, and 42C of the plurality of reels 40A, 40B, and 40C.

An upper blindfold plate 90 and a lower blindfold plate 92 may be attached to the reel case 50, so as to be located at the upper and lower parts in the front window of the reel case 50. By virtue of the blindfold plates 90 and 92, players can see only a middle level part of the reel unit 14 as shown in FIG. 1 when the reel unit 14 is at the first angular position.

Figure 5:
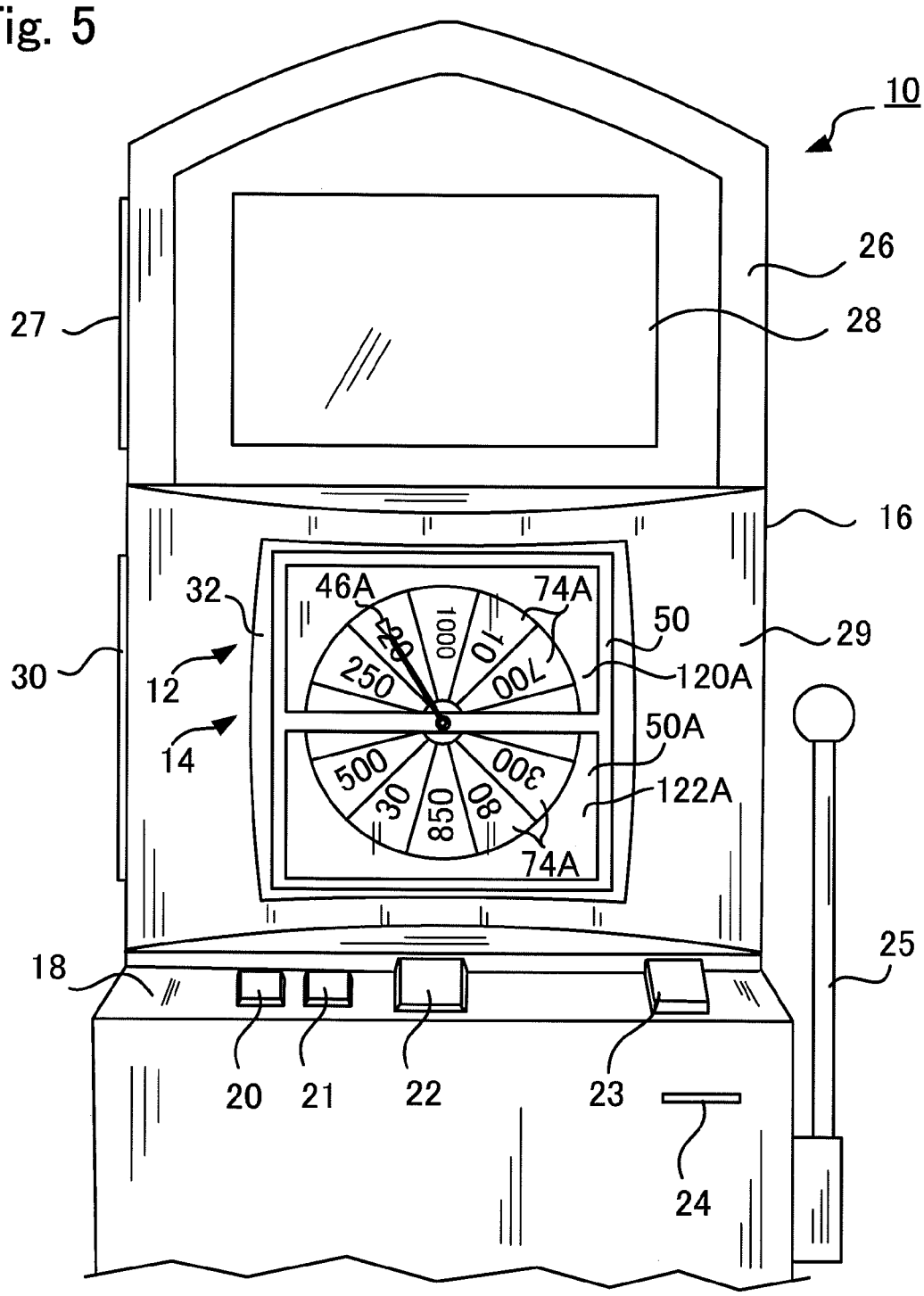
FIG. 5 is a front view of the game machine in which the reel unit has been stopped at a second position.

As shown in FIG. 5, the reel unit motor 80 pivots the reel unit 14 to a second position that is different from the first angular position by 90 degrees. In the second position, the first rotatable pointer 46A attached to the right-end reel 40A and the first lateral symbols 74A on the right lateral wall 50A of the reel case 50 are observable through the window 32 of the lower front door 29. After the reel unit motor 80 pivots the reel unit 14 to the second position and stops the reel unit 14 at the second position, players can play a second game using the right-end reel 40A with which the first rotatable pointer 46A is engaged.

Figure 6:
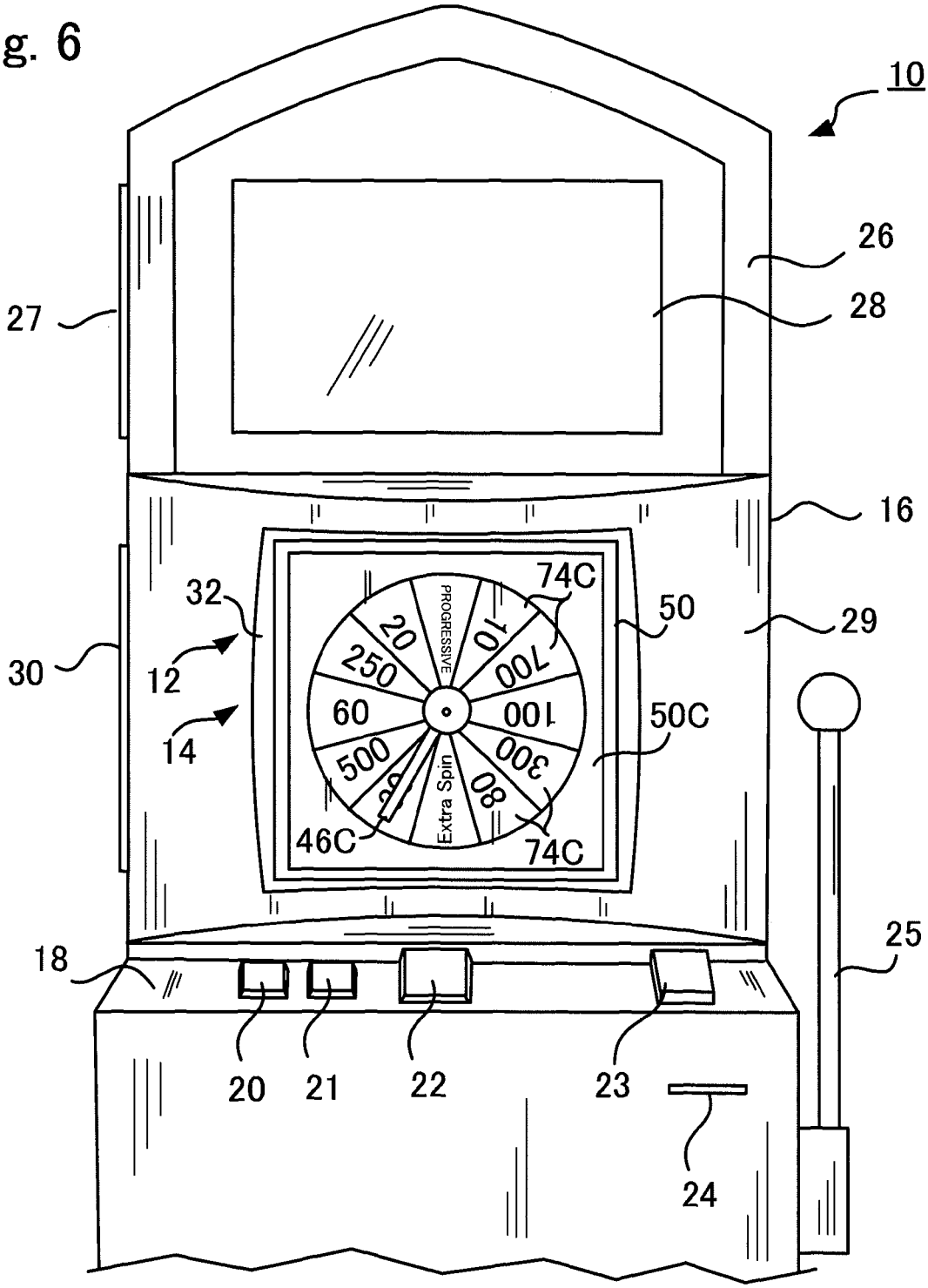
FIG. 6 is a front view of the game machine in which the reel unit has been stopped at a third angular position.

As shown in FIG. 6, the reel unit motor 80 further pivots the reel unit 14 to a third angular position that is different from the second position by 180 degrees. In the third angular position, the second rotatable pointer 46C attached to the left-end reel 40C and the second lateral symbols 74C on the left lateral wall 50C of the reel case 50 are observable through the window 32 of the lower front door 29. After the reel unit motor 80 pivots the reel unit 14 to the third angular position and stops the reel unit 14 at the third angular position, players can play a third game using the left-end reel 40C with which the second rotatable pointer 46C is engaged.

By virtue of the single reel unit 14 according to the embodiment of the present invention, players can play a plurality of types of games, and in addition, the space is effectively used.

Figure 7:
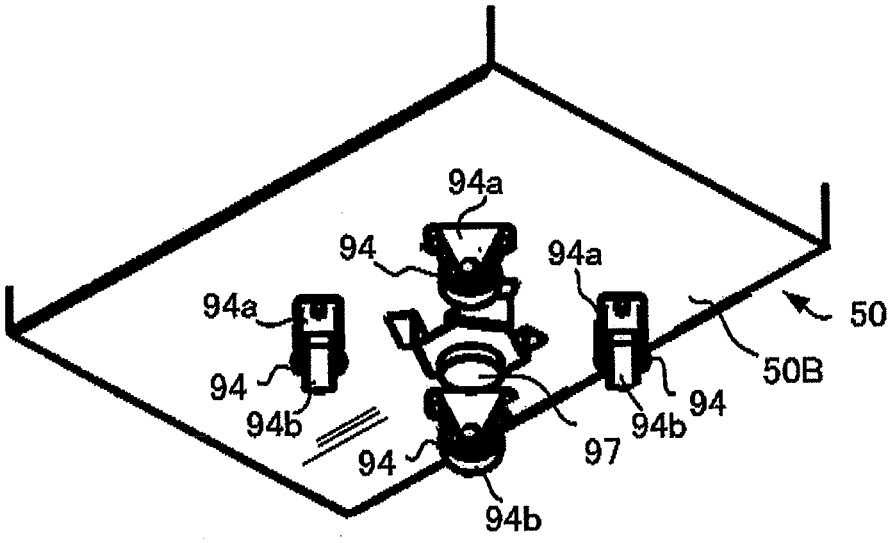
FIG. 7 is a perspective view showing the bottom of a reel unit in the symbol display device.
Figure 8:
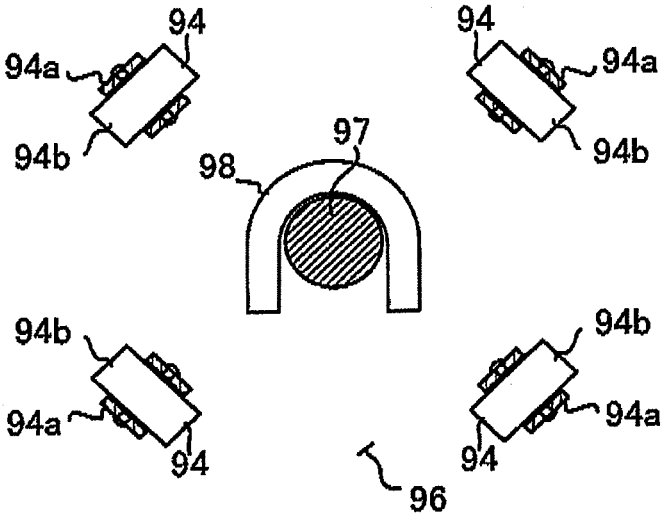
FIG. 8 is a cross section taken along line VIII-VIII in FIG. 4.

In order to facilitate the pivot action of the reel unit 14, a plurality of (four) casters 94 are provided at the lower surface of the bottom wall 50B of the reel case 50 as shown in FIGS. 4, 7, and 8. Each caster 94 includes a bracket 94*a* mounted on the lower surface of the bottom wall 50B of the reel case 50 and a roller 94*b* rotatably attached to the bracket 94*a* for facilitating pivoting of the reel unit 14. Each of the rollers 94*b* rolls on the upper surface of a base plate 96 (FIG. 4) which faces the lower surface of the bottom wall 50B of the reel case 50 and bears the weight of the reel unit 14. The base plate 96 is located inside the housing 16 and is usually hidden by the lower front door 29 (FIG. 1). Since the casters 94 facilitate pivoting of the reel unit 14, the energy consumption of the reel unit motor 80 can be reduced.

As is best shown in FIG. 7, a projection 97 is mounted on the lower surface of the bottom wall 50B of the reel case 50. On the other hand, as shown in FIGS. 4 and 8, a surrounding wall 98 having a U-shape is mounted on the upper surface of the base 96. The projection 97 is aligned with the pivot axis of the reel unit 14, whereas the surrounding wall 98 surrounds the projection 97. Since the surrounding wall 98 surrounds the projection 97 aligned with the pivot axis of the reel unit 14, the reel unit 14 can be pivoted stably without deviating from the concentricity with the pivot axis. In addition, the surrounding wall 98 and the projection 97 can be used as means for guiding the reel unit 14 when the reel unit 14 is engaged with the reel unit motor 80 for deployment of the reel unit 14. More specifically, if the projection 97 is received in the surrounding wall 98, the reel unit 14 is positioned appropriately. Since the surrounding wall 98 has a U-shape, in which a side is open, the projection 97 is easily passed through the open side of the surrounding wall 98 so as to be positioned within the surrounding wall 98. In an alternative embodiment (not shown), a similar projection may be located at the upper surface of the base 96, and a similar surrounding wall may be located at the lower surface of the bottom wall 50B of the reel case 50.

As shown in FIG. 4, the above-described reel unit motor 80 is mounted on an upper base plate 104 which is located inside the housing 16 and is usually hidden by the upper front door 26 (FIG. 1). The upper base plate 104 lies above the reel case 50, whereas the pivot shaft 82 for the reel unit 14 is located in a cutout formed at the upper base plate 104. Since the reel unit motor 80 is thus located above the reel unit 14, the reel unit motor 80 need not bear the entire weight of the reel unit 14, and the reel unit 14 can be disconnected from and connected to the reel unit motor 80 easily. Accordingly, the reel unit 14 can be repaired easily. When the reel unit 14 is disengaged from or engaged to the reel unit motor 80, the upper front door 26 and the lower front door 29 are opened.

The first and second lateral symbols 74A and 74C may be printed or written on the right and left lateral walls 50A and 50C of the reel case 50. However, at least either of the first lateral symbols 74A and the second lateral symbols 74C may be changeably displayed by one or more electronic display devices. For example, as shown in FIGS. 2 and 5, the right lateral wall 50A of the reel case 50 includes an upper right lateral wall display 120A and a lower right lateral wall display 122A which are embedded in the right lateral wall 50A of the reel case 50, so as to display the first lateral symbols 74A.

Each of the displays 120A and 122B may be a liquid crystal display, a plasma display, an organic electroluminescent display, a light emitting diode display, an electrophoretic display, or any other suitable electronic display device. The upper half of the first lateral symbols 74A is displayed on the upper right lateral wall display 120A, whereas the lower half of the first lateral symbols 74A is displayed on the lower right lateral wall display 122A. However, each of the first lateral symbols 74A may be individually displayed on a plurality of small display devices, respectively, in an alternative embodiment (not shown). In another alternative embodiment, all of the first lateral symbols 74A may be displayed on a single displace device that is correspondingly modified.

Figure 9:
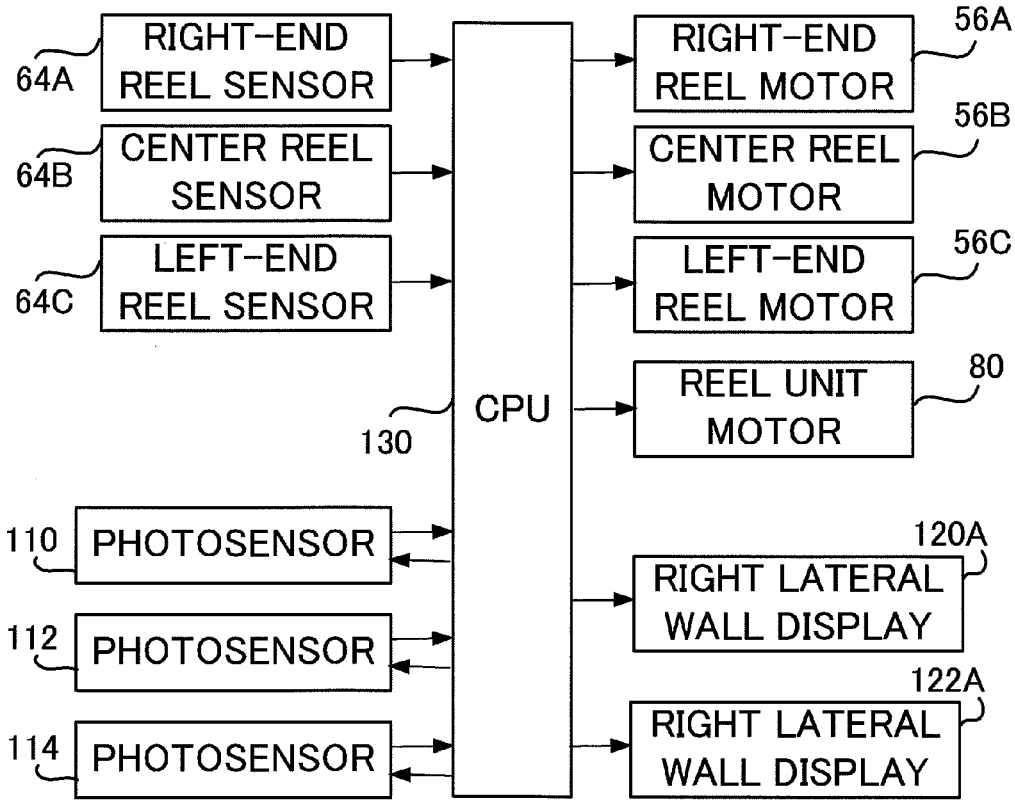
FIG. 9 is a block diagram of the game machine.

As shown in FIG. 9, the game machine 10 includes a central processing unit (CPU) 130 that controls the overall operations of the game machine 10 on the basis of a program. Various signals are supplied to the CPU 130 from the buttons 20, 21, 22, and 23, the spin lever 25, and the reel sensors 64A, 64B, and 64C. The CPU 130 supplies drive-pulses to the motors 56A, 56B, 56C, and 80. The CPU 130 controls the right lateral wall displays 120A and 122A. In addition, the CPU 130 continually drives three photosensors 110, 112, and 114, which will be described in detail, and receives signals from the photosensors 110, 112, and 114.

Figure 10:
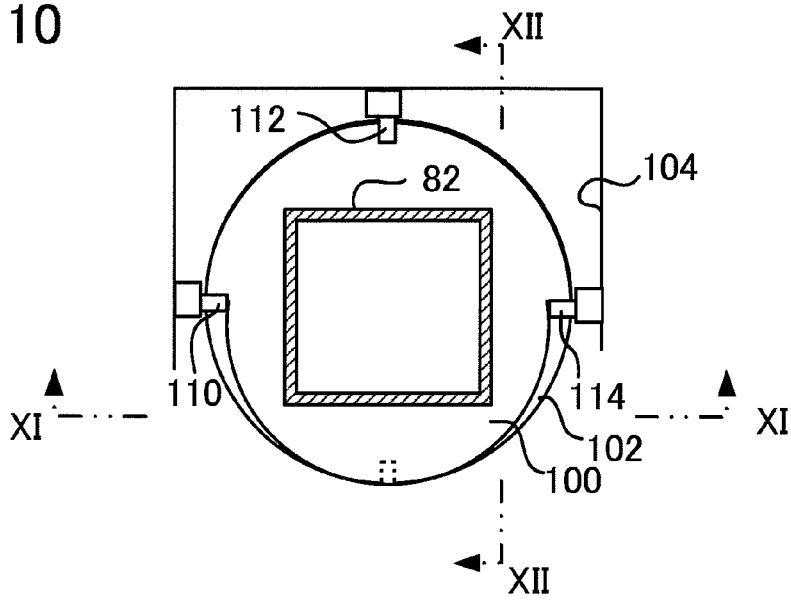
FIG. 10 is a cross section taken along line X-X in FIG. 4.
Figure 11:
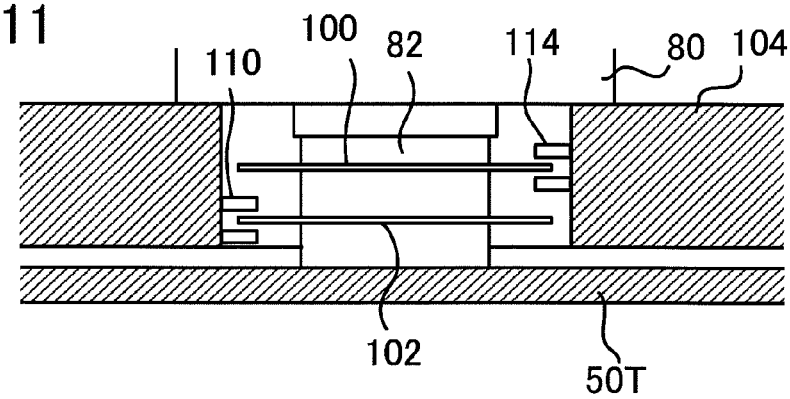
FIG. 11 is a cross section taken along line XI-XI in FIG. 10.
Figure 12:
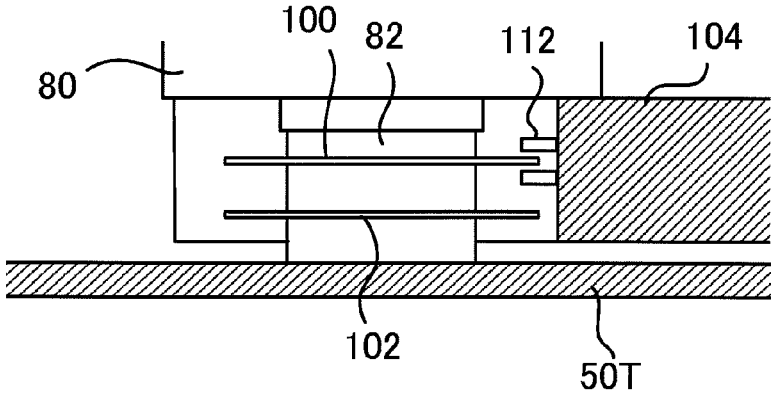
FIG. 12 is a cross section taken along line XII-XII in FIG. 10.

As shown in FIGS. 10, 11, and 12, the photosensors 110, 112, and 114 are mounted on the interior surface of a cutout formed at the upper base plate 104 in which the pivot shaft 82 is located. The photosensor 110 is mounted on the left inner surface of the cutout, whereas the photosensor 112 is mounted on the back inner surface of the cutout and the photosensor 114 is mounted on the right inner surface of the cutout. Each of the photosensors 110, 112, and 114 includes a light-emitting element that continually emits a light beam and a light-receiving element that receives the light beam from the light-emitting element when there is no interruption between the light-emitting element and the light-receiving element.

Figure 13:
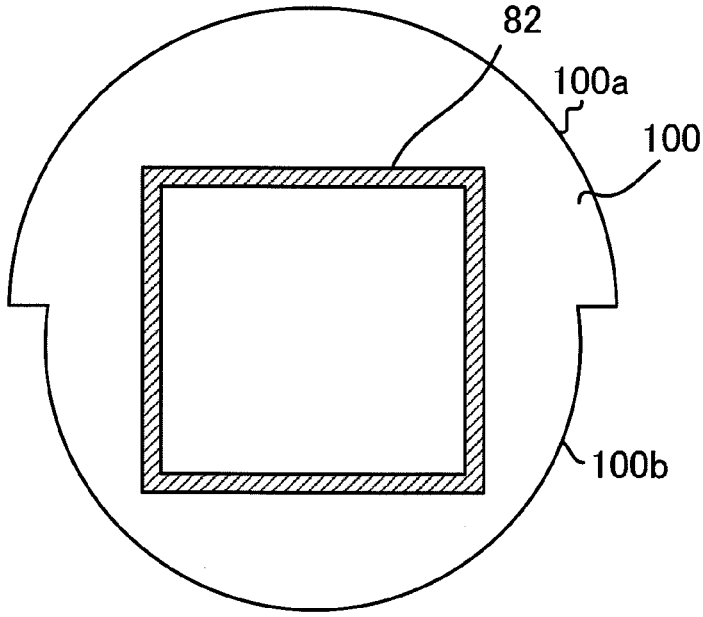
FIG. 13 is a top view of an upper disk located around a pivot shaft of the reel unit.

A pair of disks 100 and 102 are located around the hollow pivot shaft 82 at different elevations. The disks 100 and 102 are fixed to the pivot shaft 82, so that the disks 100 and 102 pivot together with the reel unit 14 when the reel unit motor 80 pivots the pivot shaft 82. As shown in FIG. 13, the upper disk 100 has two semicircular sections 100*a* and 100*b*, namely, a greater-radius semicircular section 100*a* and a smaller-radius semicircular section 100*b*. When the reel unit 14 is at the first angular position (the peripheral surfaces 42A, 42B, and 42C of the reels 40A, 40B, and 40C are seen by the player), the smaller-radius semicircular section 100*b* is oriented to the near side for the player and the greater-radius semicircular section 100*a* is oriented to the far side for the player.

Figure 14:
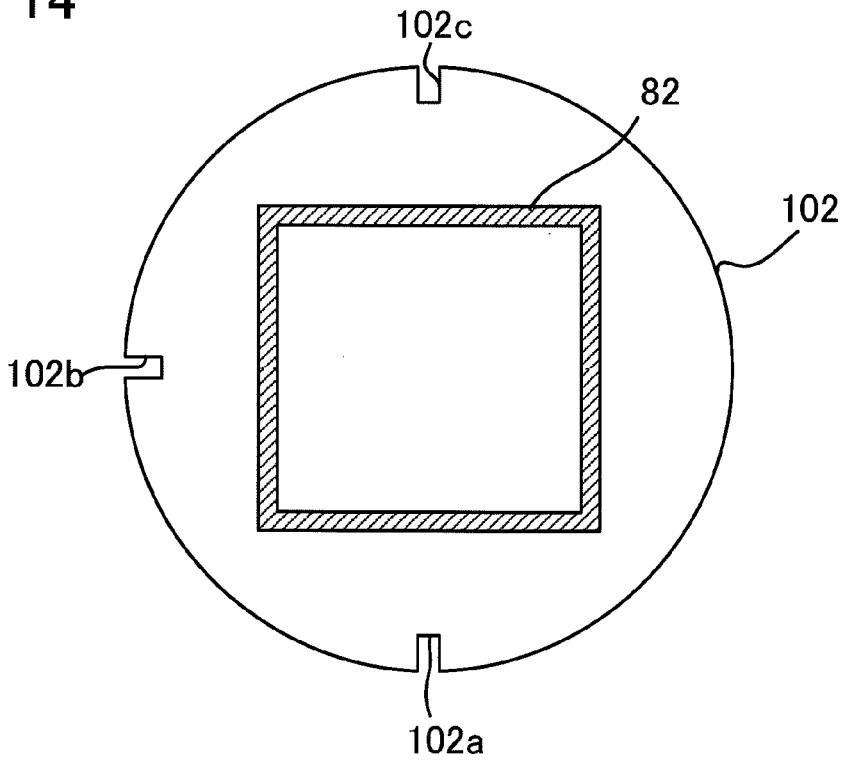
FIG. 14 is a top view of a lower disk located around the pivot shaft of the reel unit.

As shown in FIG. 14, the lower disk 102 has a generally circular contour having three slits 102*a*, 102*b*, and 102*c*. When the reel unit 14 is at the first angular position (the front face covering the peripheral surfaces 42A, 42B, and 42C of the reels 40A, 40B, and 40C is seen by the player), the slit 102*a* is oriented to the near side for the player and the slit 102*b* is oriented to the left side, whereas the slit 102*c* is oriented to the far side for the player.

As shown in FIGS. 11 and 12, the elevation of the upper disk 100 is between the light-emitting element and the light-receiving element of each of the photosensors 112 and 114. When the greater-radius semicircular section 100*a* is interposed between the elements of photosensor 112, the light beam of the photosensor 112 is interrupted, but while the greater-radius semicircular section 100*a* is away from the photosensor 112 due to the pivot action of the disk 102, the light-receiving element of the photosensor 112 receives the corresponding light-emitting element. The same is true for the photosensor 114.

On the other hand, the elevation of the lower disk 102 is between the light-emitting element and the light-receiving element of the photosensor 110. When the periphery of the lower disk 102 is interposed between the elements of photo sensor 110, the light beam of the photosensor 110 is interrupted. However, when one of the slits 102*a*, 102*b*, and 102*c* is positioned between the elements of photosensor 110, the light-receiving element of the photosensor 110 receives the corresponding light-emitting element.

Using the signal from the photosensor 110 related to the disk 102, it is possible to detect that the angle of the reel unit 14 is exactly 0, 90, or −90 degrees. When the reel unit 14 is exactly at the first angular position (the angle is zero and the front face is seen by the player), the slit 102*b* is positioned between the elements of photosensor 110, so that the light-receiving element of the photosensor 110 receives the light beam from the corresponding light-emitting element and the output signal is in the OFF state, as shown in FIG. 15. When the reel unit 14 is exactly at the second position (the angle is 90 degrees and the right side (right lateral wall 50A) is seen by the player), the slit 102*a* is positioned between the elements of photosensor 110, so that the light-receiving element of the photosensor 110 receives the light beam from the corresponding light-emitting element and the output signal is in the OFF state. When the reel unit 14 is exactly at the third angular position (the angle is −90 degrees and the left side (left lateral wall 50C) is seen by the player), the slit 102*c* is positioned between the elements of photosensor 110, so that the light-receiving element of the photosensor 110 receives the light beam from the corresponding light-emitting element and the output signal is in the OFF state. Otherwise, the periphery of the disk 102 interrupts the light beam of the photosensor 110, so that the light-receiving element of the photosensor 110 does not receive the light beam from the corresponding light-emitting element and the output signal is in the ON state.

Using the signal from the photosensor 112 related to the disk 100, it is possible to determine whether or not the angle of the reel unit 14 is between 90 and −90 degrees. When the reel unit 14 is exactly at the second position (the angle is 90 degrees and the right side (right lateral wall 50A) is seen by the player), the greater-radius semicircular section 100*a* is not positioned between the elements of photosensor 112, so that the light-receiving element of the photosensor 112 receives the light beam from the corresponding light-emitting element and the output signal is in the OFF state. When the reel unit 14 is exactly at the third angular position (the angle is −90 degrees and the left side (left lateral wall 50C) is seen by the player), the greater-radius semicircular section 100*a* is not positioned between the elements of photosensor 112, so that the light-receiving element of the photosensor 112 receives the light beam from the corresponding light-emitting element and the output signal is in the OFF state. Only when the angle of the reel unit 14 is between 90 and −90 degrees, the greater-radius semicircular section 100*a* interrupts the light beam between the elements of photosensor 112, so that the light-receiving element of the photosensor 112 does not receive the light beam from the corresponding light-emitting element and the output signal is ON state.

Using the signal from the photosensor 114 related to the disk 100, it is possible to determine whether or not the angle of the reel unit 14 is between 0 and 180 degrees. When the reel unit 14 is exactly at the first angular position (the angle is 0 degrees and the front face (covering all reels 40A, 40B, and 40C) is seen by the player), the greater-radius semicircular section 100*a* is not positioned between the elements of photosensor 114, so that the light-receiving element of the photosensor 114 receives the light beam from the corresponding light-emitting element and the output signal is in the OFF state. When the reel unit 14 is exactly at 180 degrees, the greater-radius semicircular section 100*a* is not positioned between the elements of photosensor 114, so that the light-receiving element of the photosensor 114 receives the light beam from the corresponding light-emitting element and the output signal is in the OFF state. Only when the angle of the reel unit 14 is between 0 and 180 degrees, the greater-radius semicircular section 100*a* interrupts the light beam between the elements of photosensor 114, so that the light-receiving element of the photosensor 114 does not receive the light beam from the corresponding light-emitting element and the output signal is in the ON state.

By virtue of the contours of the disks 100 and 102 and the arrangement of the photosensors 110, 112, and 114, the combination of light reception states of the light-receiving elements of the photosensors is variable when the reel unit 14 is positioned at the first angular position (0 degrees), the second angular position (90 degrees), the third angular position (−90 degrees), a position between the first and the second angular positions, a position between the second and the third angular positions, and a position between the third and the first angular positions as shown in FIG. 15. Using the combination of the light reception states of the photosensors 110, 112, and 114, the CPU 130 determines the pivot angular position of the reel unit 14 appropriately from among the first angular position, the second angular position, the third angular position, a position between the first and the second angular positions, a position between the second and the third angular positions, and a position between the third and the first angular positions. Accordingly, the CPU 130 can make a fast and precise angular orientation of the reel unit 14 to the first, second, or third angular position.

Operations of the game machine 10 will be described. Before starting operations, the reel unit motor 80 has pivoted the reel unit 14 to the first angular position and has stopped the reel unit 14 at the first angular position, so that the peripheral surfaces 42A, 42B, and 42C of the reels 40A, 40B, and 40C are observable through the window 32 of the lower front door 29, as shown in FIG. 1. A player can play a first game, i.e., a normal slot game using the visible peripheral surfaces 42A, 42B, and 42C of the plurality of reels 40A, 40B, and 40C. Once the player pushes the spin button 22 or turns the spin lever 25, a start signal is supplied from the spin button 22 or the spin lever 25 to the CPU 130. Then, the CPU 130 starts supplying drive-pulses to the reel motors 56A, 56B, and 56C for rotating the reel motors 56A, 56B, and 56C, and then stops the individual rotations of the reel motors 56A, 56B, and 56C at different random times. For example, the CPU 130 stops the left-end reel motor 56C first, the center reel motor 56B next, and then the right-end reel motor 56A.

Upon stopping all the reel motors 56A, 56B, and 56C, the CPU 130 estimates the rotational angle of each of the reels 40A, 40B, and 40C on the basis of signals received by the CPU from reel sensors 64A, 64B, and 64C and the number of pulses supplied to the respective reel motors from the CPU 130. For example, the CPU 130 estimates the rotational angle of the reel 40A on the basis of the number of pulses input to the reel motor 56A after the time of the last detection signal supplied from the reel sensor 64A that indicates the last detection of the segment 66A by the sensor 64A.

Next, the CPU 130 determines whether or not the combination of the symbols on the reels 40A, 40B, and 40C (i.e., the rotational angles of the reels 40A, 40B, and 40C) corresponds to any one of predetermined prize patterns, including a special pattern. If the combination of the symbols does not coincide with any prize pattern, the player loses the game. If the combination of the symbols coincides with a prize pattern that is not the special pattern, the CPU 130 supplies a command to a payment device (not shown) for paying a prize amount corresponding to the prize pattern in coin, and stands ready to perform the normal slot game.

If the combination of the symbols coincides with the special pattern, the CPU 130 supplies drive-pulses to the reel unit motor 80 for pivoting the reel unit 14 by 90 degrees to the second angular position as shown in FIG. 5. In the second angular position, the first rotatable pointer 46A connected to the right-end reel 40A and the first lateral symbols 74A on the right lateral wall 50A of the reel case 50 are observable by the player through the window 32 of the lower front door 29. After the reel unit motor 80 stops the reel unit 14 at the second angular position, the player can play the second game using the visible right-end reel 40A to which the first rotatable pointer 46A is connected and the visible first lateral symbols 74A on the right lateral wall 50A of the reel case 50. Each of the first lateral symbols 74A represents a prize amount to be given to the player. Accordingly, the second game is a subsidiary game (prize-amount-determining game) for determining the prize amount that the player can acquire.

In the second game, once the player pushes the spin button 22 or turns the spin lever 25, a start signal is supplied from the spin button 22 or the spin lever 25 to the CPU 130. Then, the CPU 130 starts supplying drive-pulses to the right-end reel motor 56A for rotating the right-end reel motor 56A, and then stops the rotation of the reel motor 56A at a random time.

Upon stopping the reel motor 56A, the CPU 130 estimates the rotational angle of the right-end reel 40A on the basis of the number of pulses input to the corresponding reel motor 56A after the time of the last detection signal supplied from the corresponding reel sensor 64A that indicates the last detection of the segment 66A by the sensor 64A. The rotational angle of the right-end reel 40A signifies the angle of the first rotatable pointer 46A that has been stopped. Therefore, the CPU 130 determines the first lateral symbol 74A (indicating a prize amount) pointed by the first rotatable pointer 46A. At this stage, by means of the first lateral symbol 74A indicated by the first rotatable pointer 46A, the player also knows the prize amount that the player can acquire.

The player can select to play the third game or to receive the prize amount indicated by the first rotatable pointer 46A. If the player pushes the cash button 20 to receive the prize amount, the CPU 130 supplies a command to the above-mentioned payment device (not shown) for paying the prize amount in coin, and supplies drive-pulses to the reel unit motor 80 to pivot the reel unit 14 by 90 degrees to the first angular position so as to stand ready to perform the first game again, as shown in FIG. 1.

On the other hand, if the player pushes a button (not shown) to play the third game, the CPU 130 supplies drive-pulses to the reel unit motor 80 for pivoting the reel unit 14 by 180 degrees to the third angular position as shown in FIG. 6. In the third angular position, the second rotatable pointer 46C connected to the left-end reel 40C and the second lateral symbols 74C on the second lateral wall 50C of the reel case 50 are observable by the player through the window 32 of the lower front door 29. After the reel unit motor 80 stops the reel unit 14 at the third angular position, the player can play the third game using the left-end reel 40C to which the second rotatable pointer 46C is connected and the second lateral symbols 74C on the second lateral wall 50C of the reel case 50. Each of the second lateral symbols 74C represents a multiplier that should be multiplied by the prize amount to be given to the player. As a result of the third game, the player can obtain the product of the multiplier and the prize amount in coin. However, the symbol "Extra Spin" or "PROGRESSIVE" means that the player should retry the third game. Accordingly, the third game is another subsidiary game (multiplier-determining game) for determining the multiplier that should be multiplied to the prize amount, and for determining the product (total amount) that the player can acquire.

In the third game, once the player pushes the spin button 22 or turns the spin lever 25, a start signal is supplied from the spin button 22 or the spin lever 25 to the CPU 130. Then, the CPU 130 starts supplying drive-pulses to the left-end reel motor 56C for rotating the left-end reel motor 56C, and then stops the rotation of the left-end reel motor 56C at a random time.

Upon stopping the reel motor 56C, the CPU 130 estimates the rotational angle of the left-end reel 40C on the basis of the number of pulses input to the corresponding reel motor 56C after the time of the last detection signal supplied from the corresponding reel sensor 64C that indicates the last detection of the segment 66C by the sensor 64C. The rotational angle of the left-end reel 40C signifies the angle of the second rotatable pointer 46C that has been stopped. Therefore, the CPU 130 determines the second lateral symbol 74C (indicating a multiplier) indicated by the second rotatable pointer 46C. At this stage, by means of the second lateral symbol 74C indicated by the second rotatable pointer 46C, the player also knows the multiplier.

The player can receive the total amount that is the product of the prize amount and the multiplier indicated by the second rotatable pointer 46C. The CPU 130 supplies a command to the above-mentioned payment device (not shown) for paying the total amount in coin, and supplies drive-pulses to the reel unit motor 80 for pivoting the reel unit 14 by 90 degrees to the first angular position so as to stand ready to perform the first game again as shown in FIG. 1.

If the second rotatable pointer 46C indicates the symbol "Extra Spin" or "PROGRESSIVE", the player pushes the spin button 22 or turns the spin lever 25 to replay the third game, and then a start signal is supplied to the CPU 130, again. Then, the CPU 130 starts supplying drive-pulses to the left-end reel motor 56C for rotating the left-end reel motor 56C, and then stops the rotation of the left-end reel motor 56C, again. The multiplier indicated by the second rotatable pointer 46C at this stage will be multiplied with the last total amount resulting from the last third game.

Since the first lateral symbols 74A are realized by the right lateral wall displays 120A and 122A, a wide variety of symbols can be shown. Furthermore, the game machine according can provide more kinds of games. When the reel unit motor 80 is pivoted to the first angular position as shown in FIG. 1, players can play a first game, i.e., a normal slot game using the peripheral surfaces 42A, 42B, and 42C of the plurality of reels 40A, 40B, and 40C. Thereafter, when the reel unit motor 80 is pivoted to the second angular position as shown in FIG. 5, players can play a second game using the right-end reel 40A with the first rotatable pointer 46A and the first lateral symbols 74A displayed by the right lateral wall displays 120A and 122A. Thereafter, when the reel unit motor 80 is pivoted to the third angular position as shown in FIG. 6, players can play a third game using the left-end reel 40C with the second rotatable pointer 46C and the second lateral symbols 74C displayed by the left lateral wall display 102C. Thereafter, when the reel unit motor 80 is pivoted to the second angular position again, the CPU 130 causes the right lateral wall displays 120A and 122A to present another pattern of the first lateral symbols 74A and players can play a fourth game using the right-end reel 40A with the first rotatable pointer 46A and the new first lateral symbols 74A.

In the above described embodiment, the lateral symbols 74A and 74C are at least one of numerals and letters of the alphabet. However, other types of symbols including other letters, marks, or pictures may be used as the lateral symbols in alternative embodiments (not shown).

In the above-described embodiments, the right side of the reel unit 14 is provided with the single first rotatable pointer 46A and the left side of the reel unit 14 is provided with the single second rotatable pointer 46C. However, in an alternative embodiment, two or more pointers may be disposed at least one of the right and left side of the reel unit 14. In this case, a greater variety of games may be presented.

It will be understood that the present invention has been described by way of example only and with reference to the accompanying drawings, and that improvements and modifications may be made to the invention without departing from the scope or spirit thereof.

What is claimed is:

1. A symbol display device for a game machine, comprising:

a reel unit comprising:

a plurality of reels each having a rotational axis and aligned in a manner such that the rotational axes are coincident or substantially parallel, each of the reels having a peripheral surface at which a plurality of peripheral symbols are displayed, the reels comprising an end reel arranged at an end position of the reels;

a reel supporting member that supports the reels rotatably and independently, the reel supporting member comprising a lateral wall having a plurality of lateral symbols arranged around the rotational axis of the end reel;

a plurality of driving units that rotate the reels respectively; and a pointer that rotates about the rotational axis of the end reel due to rotation of the end reel, the pointer indicating one of the lateral symbols on the lateral wall of the reel supporting member when the end reel and the pointer stop rotating; and a pivoting unit that pivots the reel unit to a first angular position at which the peripheral surfaces of the reels are observable and to a second angular position at which the pointer and the lateral symbols on the lateral wall of the reel supporting member are observable, the pivoting unit being located above the reel unit.

2. The symbol display device according to claim 1, wherein the reels comprise a second end reel arranged at a second end position of the reels opposite to the end reel, the reel supporting member comprising a second lateral wall having a plurality of second lateral symbols arranged around the rotational axis of the second end reel, the reel unit comprising a second pointer that rotates about the rotational axis of the second end reel due to rotation of the second end reel, the second pointer indicating one of the second lateral symbols on the second lateral wall of the reel supporting member when the second end reel and the second pointer stop rotating, the pivoting unit further pivoting the reel unit to a third angular position where the second pointer and the second lateral symbols on the second lateral wall of the reel supporting member are observable.

3. The symbol display device according to claim 2, wherein at least one of the lateral symbols and the second lateral symbols are changeably displayed by at least an electronic display device.

4. The symbol display device according to claim 2, wherein the reel supporting member of the reel unit further comprises a top wall having a top surface, the symbol display device further comprising:

a pivot shaft pivoted by the pivoting unit, the pivot shaft extending upwardly from the top surface of the top wall;

a pair of disks located around the pivot shaft at different elevations; and three photosensors each having a light-emitting element that emits a light and a light-receiving element that receives the light from the light-emitting element when there is no interruption between the light-emitting element and the light-receiving element, a part of one of the disks being capable of being interposed between the light-emitting element and the light-receiving element of the photosensor due to pivoting of the pivot shaft, wherein the disks comprises different contours and the photosensors are arranged so that a combination of light reception states of the light-receiving elements of the photosensors is variable when the reel unit is positioned at the first angular position, the second angular position, and the third angular position.

5. The symbol display device according to claim 2, further comprising:

a rotational shaft for the end reel rotated by one of the driving units, the end reel being mounted on the rotational shaft, the rotational shaft penetrating through the lateral wall of the reel supporting member, the pointer being mounted on the rotational shaft; and a second rotational shaft for the second end reel rotated by one of the driving units, the second end reel being mounted on the second rotational shaft, the second rotational shaft penetrating through the second lateral wall of the reel supporting member, the second pointer being mounted on the second rotational shaft.

6. The symbol display device according to claim 4, wherein the disks comprises different contours and the photosensors are arranged so that a combination of light reception states of the light-receiving elements of the photosensors is variable when the reel unit is positioned at the first angular position, the second angular position, the third angular position, a position between the first and the second angular positions, a position between the second and the third angular positions, and a position between the third and the first angular positions.

7. The symbol display device according to claim 1, wherein the lateral symbols are changeably displayed by at least an electronic display device.

8. The symbol display device according to claim 1, wherein the reel supporting member of the reel unit further comprises a bottom wall having a lower surface, the reel unit further comprising a plurality of casters each comprising a bracket mounted on the lower surface of the reel supporting member and a roller rotatably attached to the bracket for facilitating pivoting of the reel unit.

9. The symbol display device according to claim 8, further comprising a base comprising an upper surface which faces the lower surface of the bottom wall of the reel supporting member, a projection located at one of the upper surface of the base and the lower surface of the bottom wall, and a surrounding wall located at the other of the upper surface of the base and the lower surface of the bottom wall, the projection being aligned with a pivot axis of the reel unit, the surrounding wall surrounding the projection.

10. The symbol display device according to claim 1, further comprising a rotational shaft for the end reel rotated by one of the driving units, the end reel being mounted on the rotational shaft, the rotational shaft penetrating through the lateral wall of the reel supporting member, the pointer being mounted on the rotational shaft.

11. A game machine comprising:

a housing; and the symbol display device according to claim 1.

12. The game machine according to claim 11, wherein the pivoting unit is a motor that pivots the reel unit, wherein one of a cash button, a bet button, a spin button, and a credit button is located below the reel unit, and wherein the motor that pivots the reel unit is located above the reel unit.

13. The symbol display device according to claim 1, wherein the plurality of reels comprise at least three reels.

14. The symbol display device according to claim 1, wherein the plurality of reels rotate independently about the rotational axes which are aligned in a manner such that the rotational axes are coincident or substantially parallel.

15. The symbol display device according to claim 1, wherein the pivoting unit is a motor that pivots the reel unit.

* * * * *